US009169103B1

(12) United States Patent
Jenkins et al.

(10) Patent No.: US 9,169,103 B1
(45) Date of Patent: Oct. 27, 2015

(54) BOOSTER REEL

(71) Applicant: Akron Brass Company, Wooster, OH (US)

(72) Inventors: Jon A. Jenkins, Wooster, OH (US); Chris Feeney, Washington, IL (US); Lonnie Lashbrook, Washington, IL (US); Kevin Petit, Wooster, OH (US)

(73) Assignee: Akron Brass Company, Wooster, OH (US)

( * ) Notice: Subject to any disclaimer, the term of this patent is extended or adjusted under 35 U.S.C. 154(b) by 347 days.

(21) Appl. No.: 13/767,331

(22) Filed: Feb. 14, 2013

Related U.S. Application Data

(60) Provisional application No. 61/598,399, filed on Feb. 14, 2012.

(51) Int. Cl.

| | |
|---|---|
| ***A62C 35/68*** | (2006.01) |
| ***B65H 75/34*** | (2006.01) |
| ***B65H 75/30*** | (2006.01) |
| ***B65H 75/44*** | (2006.01) |

(52) U.S. Cl.
CPC ..... *B65H 75/4478* (2013.01)

(58) Field of Classification Search
CPC ..... B65H 75/4478
USPC ..... 137/355.16, 355.26; 242/389, 390, 242/390.6, 390.9, 394, 394.1, 395, 407, 242/599.3, 599.4
See application file for complete search history.

(56) References Cited

U.S. PATENT DOCUMENTS

| | | | | |
|---|---|---|---|---|
| 2,573,868 | A * | 11/1951 | Newell | 137/355.21 |
| 2,631,063 | A * | 3/1953 | Jensen | 137/355.2 |
| 5,495,995 | A * | 3/1996 | Dominique et al. | 242/390.1 |
| 2005/0103918 | A1 * | 5/2005 | Bedwell | 242/388.6 |

FOREIGN PATENT DOCUMENTS

GB 1010376 A1 * 11/1965

* cited by examiner

*Primary Examiner* — Marina Tietjen
*Assistant Examiner* — Seth W MacKay-Smith
(74) *Attorney, Agent, or Firm* — Brouse McDowell; Michael G. Craig; Heather M. Barnes

(57) ABSTRACT

A reel apparatus includes an axle having a generally hollow fluid inlet connection and a generally hollow fluid outlet connection. A generally hollow drum is coupled to the axle, the drum having a generally circular-shaped sidewall about an elongate axis and further having a pair of generally open, opposing ends, the drum comprising a tubular element. The fluid outlet connection of the axle extends through an opening in the sidewall of the drum, and the reel apparatus is rotatable upon the axle.

20 Claims, 6 Drawing Sheets

BOOSTER REEL

CROSS-REFERENCE TO RELATED APPLICATIONS

This application claims priority to U.S. provisional application 61/598,399, filed Feb. 14, 2012, the contents of which are hereby incorporated by reference.

FIELD

The present invention relates generally to booster reels, in particular to booster reels configured for use with ultra high pressure (UHP) hoses. The present invention further relates to configuring booster reels for ease of assembly.

BACKGROUND

In the fire-fighting art a booster fire hose is a preferred first-attack option for providing a rapid supply of fire suppressants such as water or other fluids while larger-volume hoses are being set up and pressurized with fluid (i.e., "charged"). The booster hose is often supplied with fluid by an auxiliary pump, and is typically coiled upon a rotatable drum of a booster reel that is mounted to a fire engine. The booster reel provides a fast and reliable way to dispense and rewind booster fire hose, and frequently includes an electric-powered mechanism to aid the dispensing and rewinding processes.

One class of booster hose is a UHP booster hose system, which operates at a much higher fluid pressure than typical booster hoses. In such systems operating fluid pressures of the booster hose can be on the order of about 1500 pounds per square inch (psi). This pressure in some cases is achievable in a matter of seconds, depending upon the pumping system employed to pump the fluid through the hose. These extreme pressures impose requirements upon the design of an associated booster reel. For example, with a charged UHP booster hose wrapped around a drum of the booster reel, extreme compression forces are generated by the hose and are exerted against the drum, potentially deforming or crushing the drum.

In addition, a charged UHP booster hose can expand in a general direction along an elongate axis of the drum, causing side disks of the drum that are intended to contain the hose on the drum to deflect and possibly become permanently deformed due to the force of the lateral hose expansion.

Furthermore, on some booster reels having a relatively small drum diameter a primary drive sprocket is connected to the side disks for coupling to a hose dispensing/rewinding mechanism of the booster reel. This drive sprocket can become misaligned with an associated motor sprocket of the dispensing/rewinding mechanism if the side disks deform as described above.

Booster reels typically include an axle upon which the drum rotates. A generally hollow fluid outlet connection is typically coupled to the axle and extends through an opening in the drum, the booster hose being connected to the outlet. Fluid for the hose is supplied to the booster hose through a fluid inlet portion of the axle that is in communication with the fluid outlet connection. Although this arrangement is satisfactory for general booster hose and booster reels, on UHP booster systems the aforementioned expansion of the UHP booster hose can exert significant force on the fluid outlet connection, causing portions of the fluid outlet connection and/or the axle to be deformed.

A further drawback of current booster reels is that they are, in general, laborious and expensive to assemble. There is a need for a booster reel that is capable of withstanding the forces exerted by UHP booster hose while also being relatively easy and economic to assemble.

SUMMARY

A booster reel is disclosed according to an embodiment of the present invention. The booster reel includes a drum having a predetermined thickness. By increasing the thickness of the drum material of the present invention in comparison with the drum material of current booster reels the structural strength of the drum is sufficient to handle the compressive forces generated by a booster hose when operating at UHP. Various materials of construction may be used to reduce the overall weight of the booster reel while maintaining the requisite structural integrity.

In addition, the drum may include a secondary ring which at least partially closes off an opening in the drum for a fluid outlet connection, thereby increasing the strength of the overall drum while also protecting the booster hose from sharp edges that may be present at the opening. Various materials of construction may be used to reduce overall weight of the reel while maintaining structural integrity.

In some embodiments of the present invention the side disks of the drum may also be strengthened or otherwise reinforced. For example, the thickness of the material selected for the side disks, such as steel, may be increased or made with reinforcing ribbing, thereby improving their resistance to deformation when exposed to compressive forces from a UHP booster hose. With proper reinforcement various materials of construction may be used to reduce overall weight of the reel while maintaining structural integrity.

The booster reel of the present invention may include a separation plate that couples a primary sprocket to a set of tie rods, thus aiding to deter movement of the primary sprocket if the side disks deflect. In addition, by adding a stiffening rib or gusset to the axle, permanent deformation of the axle due to UHP booster hose forces may be deterred.

In addition, recognizing that current booster reels can be laborious and expensive to assemble, the disclosed invention incorporates features reducing the difficulty of assembly.

In one embodiment of the present invention a reel apparatus includes an axle having a generally hollow fluid inlet connection and a generally hollow fluid outlet connection. A generally hollow drum is coupled to the axle, the drum having a generally circular-shaped sidewall about an elongate axis and further having a pair of generally open, opposing ends, the drum comprising a tubular element. The fluid outlet connection of the axle extends through an opening in the sidewall of the drum, and the reel apparatus is rotatable upon the axle.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
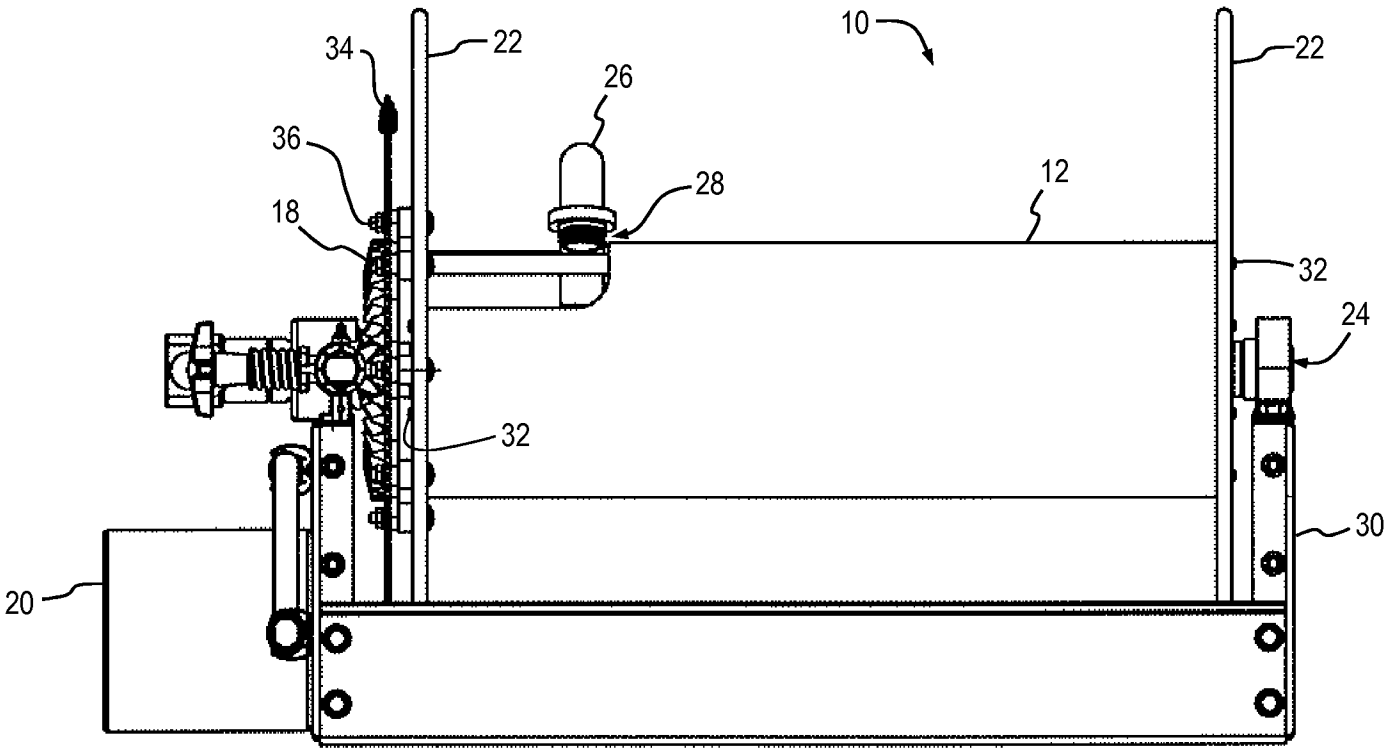
Fig. 1 Prior Art
FIG. 1 is an elevational view of a prior art booster reel.
Figure 2:
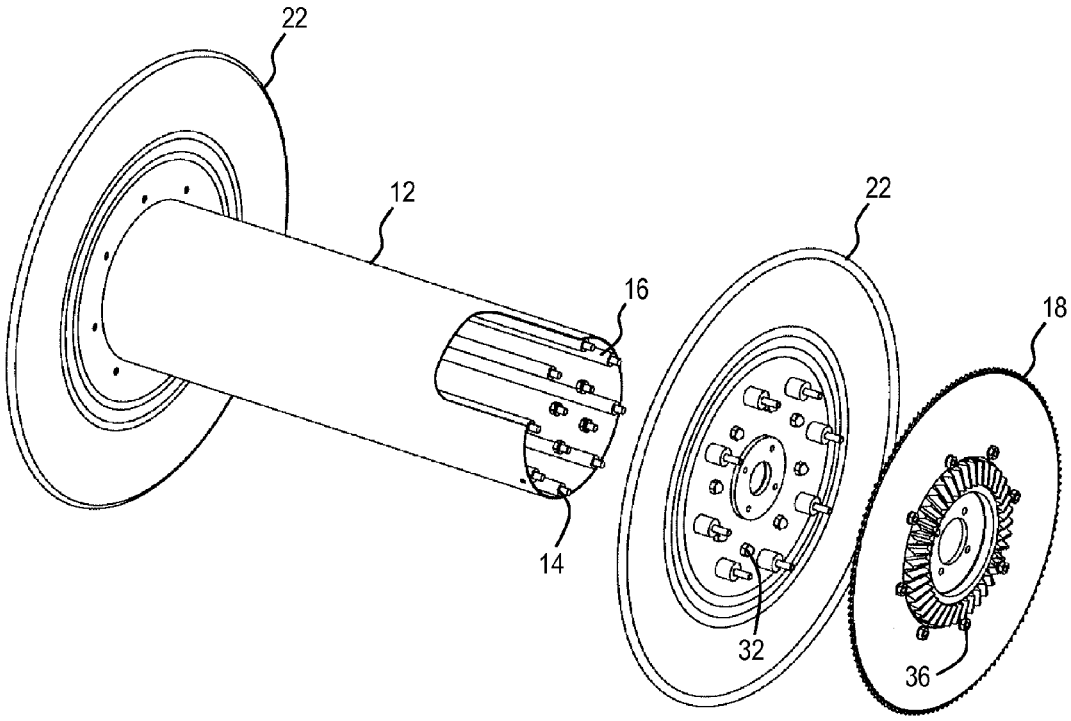
Fig. 2 Prior Art
FIG. 2 is an exploded view of several components of the booster reel of FIG. 1.
Figure 3:
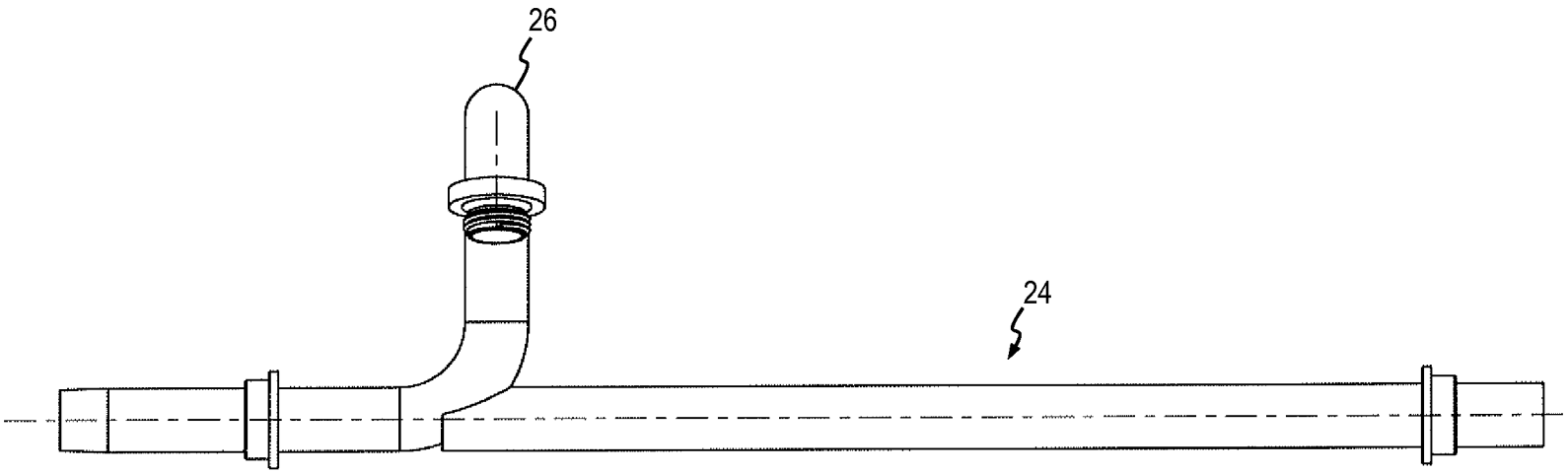
Fig. 3 Prior Art
FIG. 3 shows an axle assembly of the booster reel of FIG. 1.

A conventional booster reel 10 is shown in FIGS. 1 through 3. Booster reel 10 comprises a generally hollow drum 12, a set of tie rods 14 with an associated set of spindles 16 extending through the hollow portion of the drum, a primary sprocket 18 and a pair of side disks 22 mounted to opposing open ends of the drum. An axle assembly 24 also extends through the hollow portion of drum 12 and includes a fluid outlet connection 26 extending through an opening 28 of the drum. Drum 12 is rotatably coupled to a stationary portion 30 by axle assembly 24.

Drum 12 is typically manufactured from a generally flat, planar material, such as 14 gauge steel, and is roll-formed. The roll-formed material is then welded together along a longitudinal seam.

Tie rods 14 are used to connect the two side disks 22 together. Conventional booster reels typically use tie rods 14 made of threaded rods, the ends of the tie rods being secured to the side disks 22 with acorn nuts 32 on both ends. Tie rods 14 may be covered by separately-made spindles 16, typically a hollow tube. Spindles 16 provide structural support for drum 12 and also provide protection to the tie rods 14.

Primary sprocket 18 is connected to an electric motor 20 via a drive chain 34. Primary sprocket 18 may be connected to one of the side disks 22 using threaded fasteners 36, independent of tie rods 14. The side disks 22 are typically manufactured from materials such as 16 gauge steel.

Figure 4:
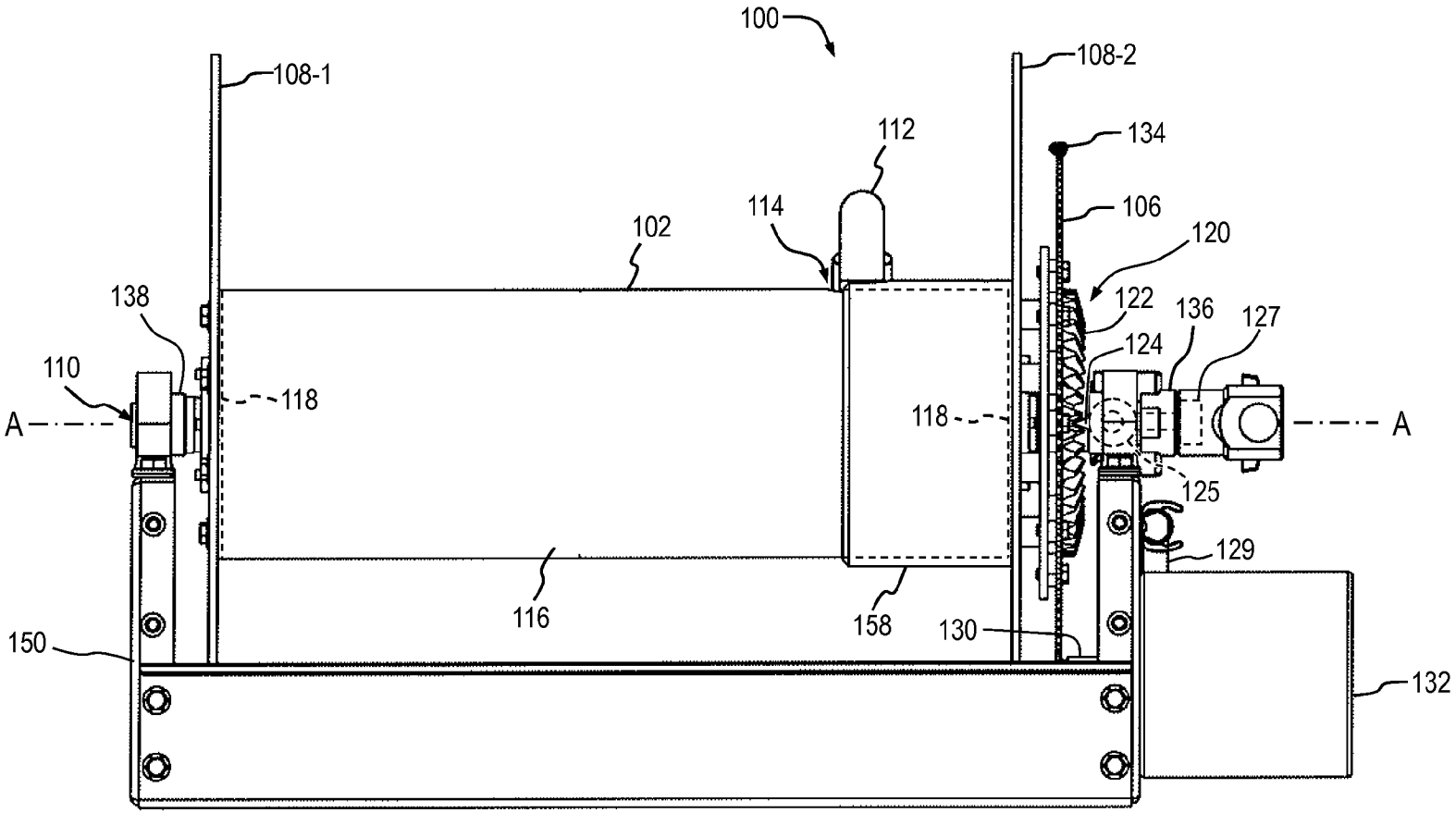
FIG. 4 is an elevational view of a booster reel according to an embodiment of the present invention.
Figure 5:
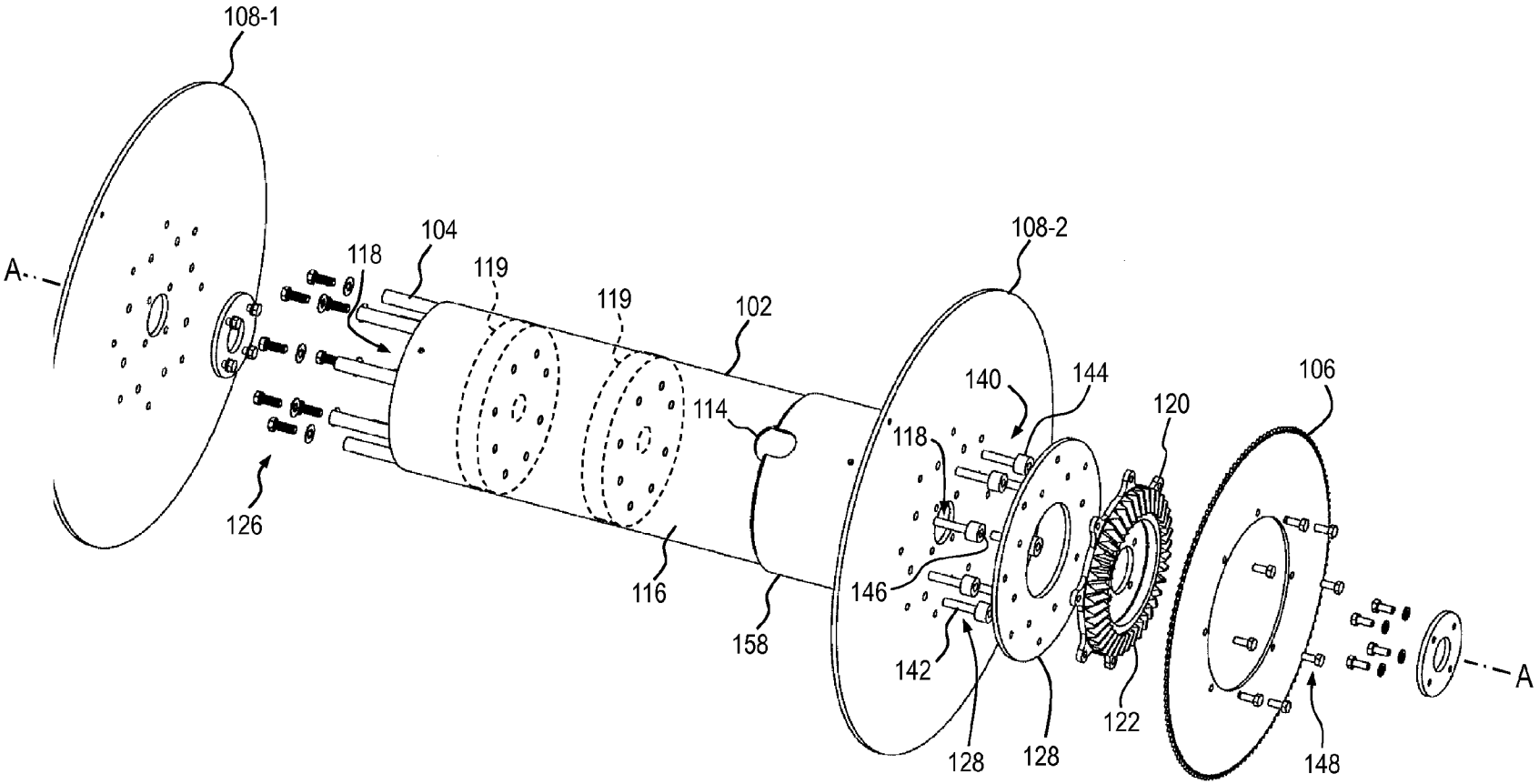
FIG. 5 is an exploded view of several components of the booster reel of FIG. 4.
Figure 6:
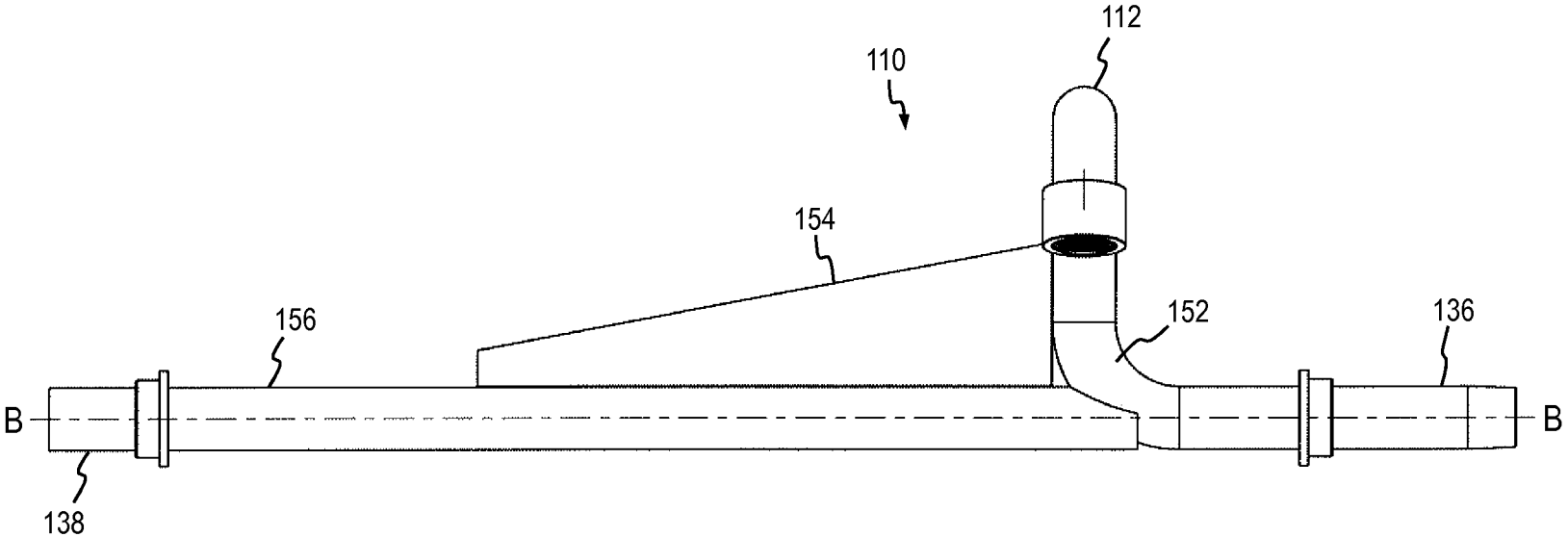
FIG. 6 shows an axle assembly of the booster reel of FIG. 4.

A booster reel 100 is shown in FIGS. 4 through 6 according to an embodiment of the present invention. Booster reel 100 comprises a generally hollow drum 102, a plurality of tie rods 104 extending through the hollow portion of the drum, a primary sprocket 106 and a pair of opposing side disks 108. An axle assembly 110 having an elongate axis also extends through the hollow portion of drum 102 and includes a fluid outlet connection 112 extending through an opening 114 in a sidewall 116 of the drum.

Drum 102 is generally preferably circularly-shaped about an elongate axis "A" and may include a pair of opposing open ends 118. In some embodiments of the present invention drum 102 may be manufactured as a generally hollow, tubular element cut to a predetermined length. As a non-limiting example, drum 102 may be made from tubing having a predetermined wall thickness, such as about 3/16-inch wall tubing. The select drum 102 side wall thickness preferably provides sufficient structural strength to withstand forces exerted upon the drum by UHP booster hose. Drum 102 may further include one or more internal reinforcement structures 119, including spokes, that are made separately and joined to the drum, or made integral with the drum. Any suitable material may be selected for drum 102 including, without limitation, steel. In some embodiments of the present invention the tubular element may be integral and unitary. Furthermore, the tubular element may be made by extrusion, casting and machining, among other processes.

Booster reel 100 may optionally include a manual drive 120 comprising a bevel gear 122, a pinion gear 124 in engagement with the bevel gear and coupled to a rotatable override shaft 125, and a tensioner 127 coupled to the override shaft. In use, a crank handle 129 may be removed from a stowed position as shown in FIG. 4 and detachably coupled to override shaft 125. After crank handle 129 is coupled to override shaft 125 the crank handle is rotated clockwise or counterclockwise as desired to wind or unwind hose from drum 102. The rotating motion of crank handle 129 causes override shaft 125 to rotate, in turn causing pinion gear 124 to rotate. The rotating motion of pinion gear 124 causes bevel gear 122 to rotate, in turn causing drum 102 (to which the bevel gear is coupled) to rotate. Tensioner 127 places an adjustable amount of drag on override shaft 125 to deter free-wheeling rotation of drum 102 and/or act as a brake to deter unwanted movement of drum 102. Alternatively, tensioner 127 may be adjusted such that little or no drag is placed on override shaft 125, allowing drum 102 to "free-wheel."

In some embodiments of the present invention a plurality of tie rods 104 comprise a tie rod portion and a spindle portion made as an integral, unitary piece rather than separate pieces in the manner of the tie rods 14 and spindles 16 discussed above. Either or both of opposing ends of tie rods 104 may be threaded to accept threaded fasteners such as tie rod fasteners 126 to ease assembly of booster reel 100. In one embodiment of the present invention tie rod fasteners 126 may be utilized to couple a first side disk 108 (hereafter "108-1") to a first end of drum 102, the fasteners extending through corresponding apertures in the first side disk to engage corresponding tie rod ends.

Primary sprocket 106 is preferably coupled to an isolation plate 128 that is in turn coupled to the tie rods 104 facially adjacent to a second side disk 108 (hereafter "108-2"). This separates or spaces apart primary sprocket 106 from the associated second side disk 108-2 such that, if the second side disk deflects under stresses exerted by a pressurized UHP hose, for example, the primary sprocket substantially retains its position in alignment with a motor sprocket 130 of an associated electric motor 132 (FIG. 4). This aids to deter a chain drive 134 extending between primary sprocket 106 and motor sprocket 130 from jumping off the sprockets.

The first and second side disks 108-1, 108-2 are each preferably coupled to one of the opposing open ends 118 of drum 102, generally closing off the open ends. Side disks 108-1, 108-2 are preferably made of a relatively thick material, such as steel having sufficient structural strength to substantially resist deflection during pressurization and expansion of a not-shown UHP booster hose wrapped around drum 102, and may include reinforcing ribs (not shown).

With reference to FIG. 6, axle assembly 110 includes a generally hollow fluid outlet connection 112. A hose, such as a fire suppression hose (not shown) may be coupled to fluid outlet connection 112 to receive a supply of pressurized fluid. Axle assembly 110 further includes a generally hollow fluid inlet connection 136 configured to receive a supply of pressurized fluid from a fluid supply source. An axle support 138 of axle assembly 110 is generally aligned with fluid inlet connection 136 and oriented in opposition to the fluid inlet connection. In this configuration fluid inlet connection 136 and axle support 138 may serve as an axle upon which drum 102 rotates.

With reference to FIGS. 4 through 6 together, in some embodiments of the present invention a plurality of first drum drive fasteners 140 may be used to assemble together several components of booster reel 100. First drum drive fasteners 140 include a shank portion 142 that is threaded to engage a corresponding threaded end of tie rods 104. A standoff or spacer portion 144 of first drum drive fasteners 140 includes a receptacle 146 that is threaded to accept a second drum drive fastener 148. Tie rods 104 are inserted into the generally hollow interior portion of drum 102 and first drum drive fasteners 140 are inserted through corresponding apertures in second side disk 108-2 (FIG. 5) to engage the threaded ends of the tie rods, thereby coupling the second side disk to a second end of the drum. Isolation plate 128, bevel gear 122, and primary sprocket 106 may be stacked upon receptacles 146 of first drum drive fasteners 140 and coupled to the receptacles with second drum drive fasteners 148 that extend through correspondingly-aligned openings in the isolation plate, bevel gear, and primary sprocket. In this configuration bevel gear 122 and primary sprocket 106 are facially adjacent isolation to plate 128. The first side disk 108-1 is coupled to the first, opposing end of drum 102 in the manner previously discussed, with tie rod fasteners 126 extending through corresponding apertures in the first side disk to engage the threaded ends of the tie rods.

During assembly of booster reel 100 axle assembly 110 is preferably arranged such that fluid outlet connection 112 extends through opening 114 in sidewall 116 of drum 102, and fluid inlet connection 136 extends through generally aligned openings in second side disk 108-2 and the assembled-together isolation plate 128, bevel gear 122 and primary sprocket 106. This drum assembly is rotatably coupled to a stationary portion 150 at fluid inlet connection 136 and axle support 138. Chain drive 134 is coupled between primary sprocket 106 and motor sprocket 130 of electric motor 132, which can be mounted to stationary portion 150.

To facilitate dispensing and rewinding of hose on drum 102, electric motor 132 is preferably configured such that its output is reversible between first and second directions of rotation, e.g., clockwise and counter-clockwise rotation. Alternatively, electric motor 132 may be deactivated and/or disengaged (or omitted from booster reel 100 altogether) to permit manual dispensing of hose from drum 102 and rewinding of the hose upon the drum by manually rotating the drum with manual drive 120 as described above.

In operation of booster reel 100 a user activates electric motor 132 to operate in a first direction of rotation to dispense hose stored upon drum 102. The rotating motion of the output of electric motor 132 causes, in turn, motor sprocket 130, chain drive 134, primary sprocket 106, and drum 102 to likewise rotate in a first direction, unwinding the hose from the drum. Alternatively, the hose may be manually dispensed from drum 102 by using manual drive 120 and/or by simply pulling on the hose to "unwind" it from the drum.

Once the desired amount of hose has been dispensed power is removed from electric motor 158. Alternatively, if the hose is manually dispensed the users discontinue operation of manual drive 120 and/or unwinding the hose. Tensioner 127 may be adjusted as desired to deter movement of drum 102, as described above. Pressurized fluid from a fluid supply source is provided to axle assembly 110 at fluid inlet connection 136. The pressurized fluid is communicated to fluid outlet connection 112 through a generally hollow tube or pipe 152 that extends between the fluid inlet connection and the fluid outlet connection. The pressurized fluid is then provided to the not-shown hose coupled to fluid output connection 112 for dispensing by the user.

When the hose is to be stored upon drum 102 the user turns off the supply of pressurized fluid. The user may also remove at least some drag on override shaft 125 by adjusting tensioner 127, allowing drum 102 to rotate with a desired amount of drag (or no drag) from manual drive 120. The user then activates electric motor 132 in a second, opposing direction of rotation causing, in turn, motor sprocket 130, chain drive 134, primary sprocket 106, and drum 102 to likewise rotate in a second, opposing direction to wind the hose upon drum 102. Alternatively, the hose may be manually rewound using manual drive 120 as discussed above. Once the hose is rewound upon drum 102 tensioner 127 may be adjusted as desired to deter further movement of the drum.

With particular reference now to FIGS. 5 and 6, in some embodiments of the present invention axle assembly 110 may include a gusset 154 oriented generally along an elongate axis "B" of the axle and extending generally between an axle portion 156 and fluid outlet connection 112. Gusset 154 provides added structural strength to axle assembly 110 to aid in deterring deflection or deformation of fluid outlet connection 112 and/or drum 102 when the axle assembly is pressurized with fluid under ultra-high pressure conditions.

A drum ring 158 (FIG. 5) may optionally be utilized to generally surround at least a portion of circular sidewall 116. Drum ring 158 may further be configured to at least partially close off opening 114 proximate the exit of fluid outlet connection 112 from drum 102 (FIG. 4). Drum ring 158 aids to at least partially prevent exposure of sharp edges proximate opening 114 that could damage a not-shown booster hose coiled onto drum 102. Drum ring 158 and also provides an extra measure of strength in the region of opening 114, as the opening is typically an area that is otherwise prone to deformation when axle assembly 110 is pressurized with fluid.

The disclosed invention is suitable for booster reels used in ultra high pressure applications that operate, for example, at fluid pressures of 800 psi or more, as well as general everyday applications that operate at fluid pressures below 800 psi. The aforementioned features aid to increase the service life of the booster reel in severe-duty (e.g., UHP fluid) applications.

In addition, the improvements in assembly reduces the amount of assembly labor and the overall cost of the booster reel in comparison to conventional booster reels. Non-limiting examples of such improvements include drum 102 formed as a tubular element, tie rods 104 having integral spindles, and first drum drive fasteners 140 configured to secure side disk 108-2 to drum 102 and further configured to receive the stacked-together isolation plate 128, bevel gear 122 and primary sprocket 106.

The present invention comprises improved strength and improved ease of assembly for UHP applications as well as for use with lower fluid-pressure booster reel configurations. However, it will be appreciated that teachings of this invention may be applied to booster reels of any size. One skilled in the art will also recognize that any suitable material used for fabricating the components of the booster reel. Similarly, any suitable manufacturing process may be used for fabricating and finishing the components of the disclosed booster reel. Lastly, the disclosed invention may be utilized to advantage in any application and any industry that uses a similar reel, whether it is UHP, or a more standard application (i.e., generally up to 800 psi operating pressure).

The various elements of booster reel 100 may be formed as separate elements or may be combined as unitary pieces as desired. The aforementioned elements may be made from any suitable material that is compatible with other components of booster reel 100 and the expected environment. Non-limiting examples of such materials include metals such as steel, plastic, and composites. The elements may be fabricated using any conventional processes such as, without limitation, molding, stamping, casting and machining, and may also be finished by such processes as painting, plating and coating, or left unfinished.

Although the foregoing discussion of booster reel 100 is directed to use with fluid-transmitting hoses, and particularly for use in connection with fire-suppression equipment, it will be appreciated that the booster reel may be used to receive, store, and dispense any suitable elements. Example elements include, but are not limited to, cable, rope, and air, gas and fuel hoses.

While this invention has been shown and described with respect to a detailed embodiment thereof, it will be understood by those skilled in the art that changes in form and detail thereof may be made without departing from the scope of the claims of the invention.

What is claimed is:

1. A reel apparatus, comprising:

an axle having a generally hollow fluid inlet connection and a generally hollow fluid outlet connection;

a generally hollow drum coupled to the axle, the drum having a generally circular-shaped sidewall about an elongate axis and further having a pair of generally open, opposing ends, the drum comprising a tubular element; and a drum ring generally surrounding at least a portion of the sidewall of the drum and at least partially closing off the opening in the sidewall, the fluid outlet connection of the axle extending through an opening in the sidewall of the drum, and the reel apparatus being rotatable upon the axle.

2. The reel apparatus of claim 1, further including a pair of side disks, a side disk being coupled to each of the open ends of the drum, the side disks generally closing off the open ends of the drum.

3. The reel apparatus of claim 2, further including a plurality of tie rods extending through the hollow portion of the drum, the tie rods being coupled to each side disk at opposing ends of the tie rods.

4. The reel apparatus of claim 3 wherein the tie rods further include a spindle portion.

5. The reel apparatus of claim 4 wherein the spindle portions are integral to the tie rods.

6. The reel apparatus of claim 2, further comprising an isolation plate, the isolation plate being facially adjacent to a select one of the side disks.

7. The reel apparatus of claim 6 wherein the isolation plate is coupled to a plurality of tie rods, the tie rods further being coupled to the select side disk.

8. The reel apparatus of claim 6, further including a bevel gear coupled to, and facially adjacent to, the isolation plate.

9. The reel apparatus of claim 6, further including a primary sprocket coupled to, and facially adjacent to, the isolation plate.

10. The reel apparatus of claim 1, wherein the axle further comprises:

an axle portion; and a gusset, the gusset being oriented generally along an elongate axis of the axle and extending generally between the axle portion and the fluid outlet connection.

11. A reel apparatus, comprising:

an axle having a generally hollow fluid inlet connection, a generally hollow fluid outlet connection, and a gusset, the gusset being oriented generally along an elongate axis of the axle and extending generally between the axle portion and the fluid outlet connection;

a generally hollow drum coupled to the axle, the drum having a generally circular-shaped sidewall about an elongate axis and having a pair of generally open, opposing ends, the drum comprising a tubular element; and a drum ring generally surrounding at least a portion of the sidewall of the drum and at least partially closing off the opening in the sidewall;

the reel apparatus being rotatable upon the axle.

12. The reel apparatus of claim 11 wherein the tie rods further include a spindle portion.

13. The reel apparatus of claim 12 wherein the spindle portions are integral to the tie rods.

14. The reel apparatus of claim 11, further comprising an isolation plate, the isolation plate being facially adjacent to a select one of the side disks.

15. The reel apparatus of claim 14 wherein the isolation plate is coupled to a plurality of tie rods, the tie rods further being coupled to the select side disk.

16. The reel apparatus of claim 14, further including a primary sprocket coupled to, and facially adjacent to, the isolation plate.

17. The reel apparatus of claim 11, further including a pair of side disks, a side disk being coupled to each of the open ends of the drum, the side disks generally closing off the open ends of the drum.

18. The reel apparatus of claim 17, further including a plurality of tie rods extending through the hollow portion of the drum, the tie rods being coupled to each side disk at opposing ends of the tie rods.

19. A method for assembling a reel apparatus, comprising the steps of:

obtaining an axle having a generally hollow fluid inlet connection and a generally hollow fluid outlet connection; and coupling a generally hollow drum to the axle, the drum having a generally circular-shaped sidewall about an elongate axis and further having a pair of generally open, opposing ends, the drum comprising a tubular element, coupling a drum ring such that it generally surrounds at least a portion of the sidewall of the drum, and at least partially closes off the opening in the sidewall;

the fluid outlet connection of the axle extending through an opening in the sidewall of the drum, and the reel apparatus being rotatable upon the axle.

20. The method of claim 19, further including the steps of;

coupling a pair of side disks to the drum, a side disk being coupled to each of the open ends of the drum, the side disks generally closing off the open ends of the drum; and locating an isolation plate facially adjacent to a select one of the side disks.

* * * * *